United States Patent [19]

Ettridge

[11] 4,191,515

[45] Mar. 4, 1980

[54] SEALING SYSTEM FOR A ROTARY MACHINE

[76] Inventor: John P. Ettridge, 235 Diagonal Rd., Warradale, Australia, 5046

[21] Appl. No.: 893,344

[22] Filed: Apr. 4, 1978

[30] Foreign Application Priority Data

Apr. 6, 1977 [AU] Australia ..... PC9688

[51] Int. Cl.[2] ..... F01C 1/02; F01C 19/08; F01C 21/12

[52] U.S. Cl. ..... 418/61 R; 418/64; 418/142; 418/144

[58] Field of Search ..... 418/61 R, 64, 142, 144

[56] References Cited

U.S. PATENT DOCUMENTS

| | | | |
|---|---|---|---|
| 2,423,507 | 7/1947 | Lawton | 418/61 R |
| 3,193,186 | 7/1965 | Peras | 418/144 |
| 3,966,365 | 6/1976 | Ulrich, Jr. | 418/61 R |
| 4,021,160 | 5/1977 | Todorovic | 418/61 R |

FOREIGN PATENT DOCUMENTS

| | | | |
|---|---|---|---|
| 1166548 | 3/1964 | Fed. Rep. of Germany | 418/142 |
| 1386741 | 3/1975 | United Kingdom | 418/142 |

*Primary Examiner*—John J. Vrablik

*Attorney, Agent, or Firm*—Oldham, Oldham, Hudak & Weber Co.

[57] ABSTRACT

A rotary machine wherein a rotor orbits without rotation within a casing, the rotor carrying blades in blade slots to form working chambers between the rotor and the interior of the casing. The machine carries sealing means to co-operate between the rotor end faces and the side walls of the casing, with the sealing means including seals and enclosing said blade slot areas and a seal sealing engaging adjacent the rotors circumference.

2 Claims, 6 Drawing Figures

SEALING SYSTEM FOR A ROTARY MACHINE

This invention relates to an improved sealing system for a rotary machine, particularly those of the orbital type where the rotor orbits within the orbital chamber without rotating therein.

BACKGROUND OF THE INVENTION

Orbital rotary machines are known, for example as described in my earlier Australian Patent No. 474,336 and in Australian Patent Application No. 19025/76. These machines have known definite advantages, such as a very low sealing blade speed, due to the fact that for each revolution of the crank shaft, that each blade merely oscillates across the surface of the interior of the orbital chamber or housing for a distance equal to twice the throw of the crank. Hence instead of for each revolution the blade travelling a distance of the circumference of the interior of the casing or housing, the blade only travels the distance of twice the crank throw.

It will be realised that the chambers between each blade in the rotor must be sealed, so that there is no transfer of fluid between the chambers, or loss of pressure from a working chamber.

SUMMARY OF THE INVENTION

While development of the blades themselves has resulted in satisfactory sealing between the blade and the interior of the housing wall, by for example the blade being of a two part or multiple part construction with the parts being biased individually to form as it were a labyrinth seal, it is also necessary to seal around the slot of the vane in the rotor, and the present invention provides a complete sealing system around the vane slot, and also between the rotor and the side walls of the housing. Thus the invention provides a sealing means around each vane slot, and sealing means between the end faces of the rotor and the side faces of the housing, these two sealing means co-operating with each other to minimise leakage from the working chamber.

DESCRIPTION OF THE PREFERRED EMBODIMENT

Figure 1:
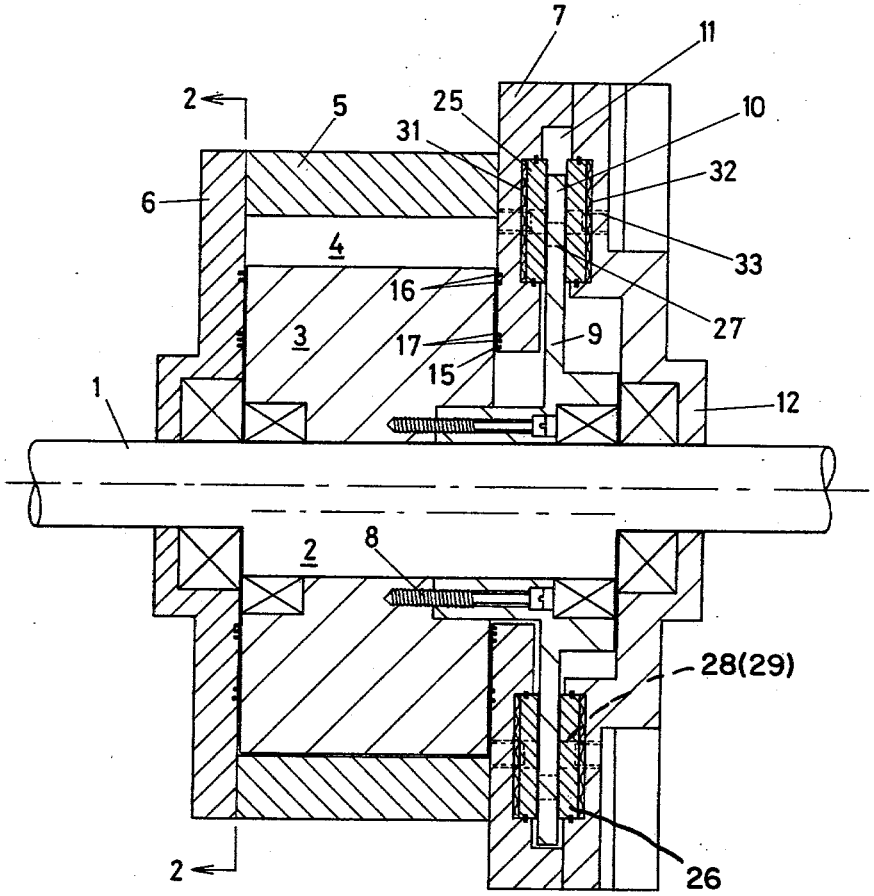
FIG. 1 shows an example of the invention, showing a rotary machine in cross section along the lines 1—1 of FIG. 2.
Figure 2:
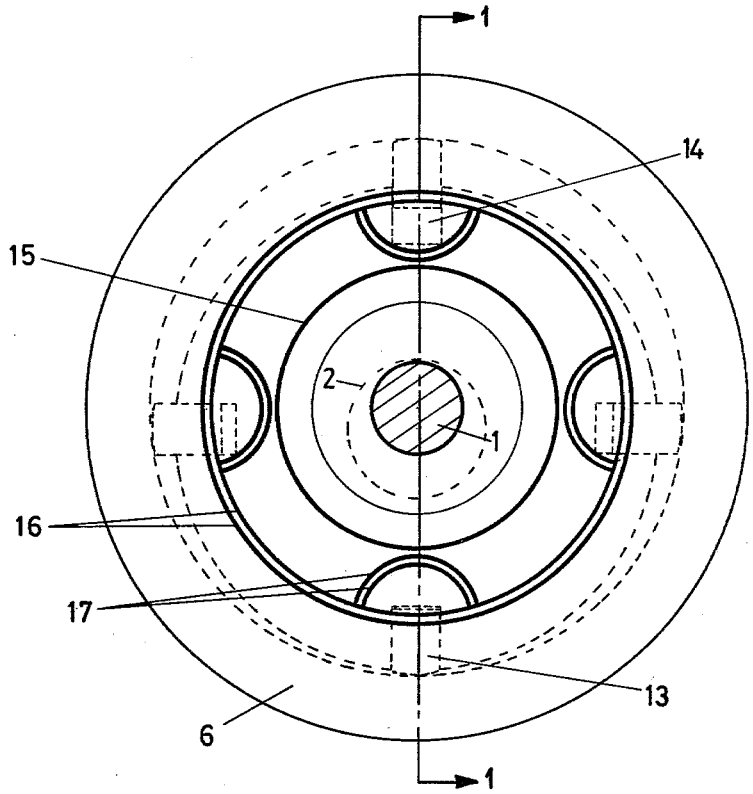
FIG. 2 shows an end elevation along the lines 2—2 of FIG. 1.
Figure 6:
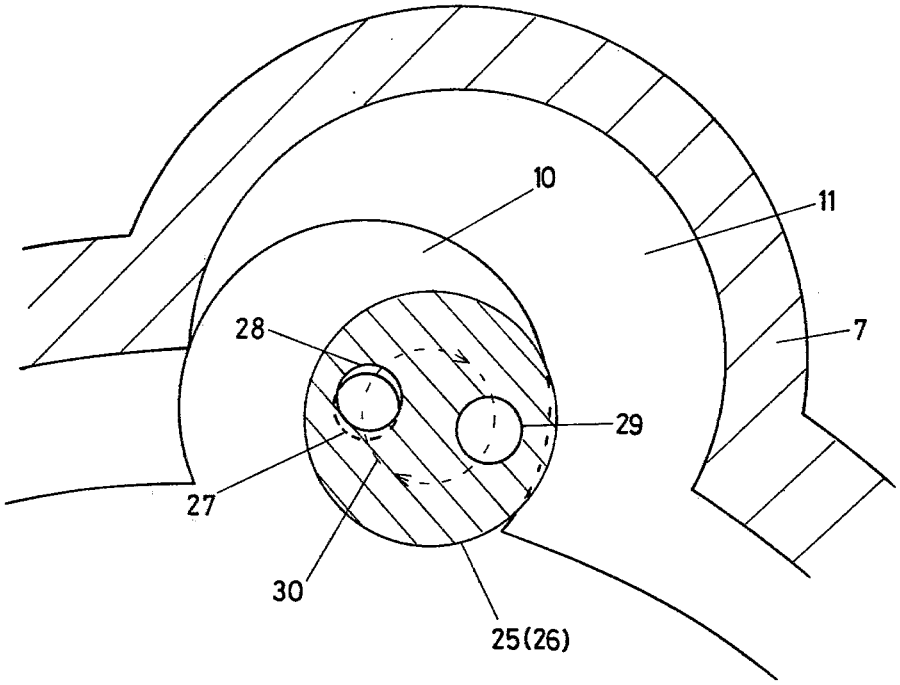
FIG. 6 shows further details of the invention incorporating valve means for controlling the flow of fluid into and from the working chamber.
Figure 3:
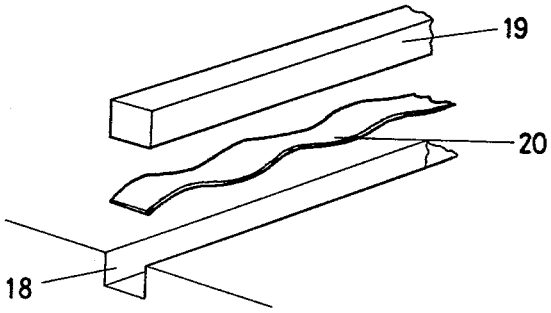
FIG. 3 shows an exploded view of a portion of the seal.

As shown in FIGS. 1 to 3, the machine comprises a shaft 1 having an eccentric 2 carrying a rotor 3 working in a chamber 4 provided in a stator casing 5, the rotor 3 being freely mounted on the eccentric 2.

The chamber is enclosed by a side plate 6 and a porting side plate 7. The rotor 3 carries with it by keys 8 a lobe plate 9 having a plurality of lobes 10 working in respective lobe recesses 11 formed in the porting side plate 7, an enclosing plate 12 covering the lobe plate and the lobe recess 11.

The rotor 3 is guided in its motion to partake of an orbital movement in the chamber 4 by the lobes 10 co-operating within the lobe recesses 11, and provision is made for the lobe 10 to act as a valve plate to regulate the flow of fluid into and out of the chamber 4.

Vanes 13 are mounted in vane slots 14 to create working chambers between adjacent vanes 13. According to the invention provision is made to prevent or minimise the escape of fluid from the working chambers.

As shown in FIGS. 1 and 2 there is provided an oil control ring 15, compression ring or rings 16, and vane slot rings 17. The arcuate vane slot rings are dimensioned so that each vane slot 14 can traverse back and forth inside its respective vane slot sealing ring 17. As shown in FIG. 3 each of the rings can be formed of a slot 18 in which is positioned a ring 19, the ring 19 being biased outwardly of the slot by a spring 20, the spring preferably being a wave spring. As shown in FIG. 2 there is a single oil ring 15 and pairs of concentric compression rings 16 and vane slot rings 17, but it is to be realised that there may be two concentric oil rings 15, or alternatively single rings 16 and 17 may be utilised. The compression rings 16 are positioned so that when the rotor 3 is furthest away from the stator 6, that the seal 16 is at the top of the rotor 3, and when the rotor 3 is close to the stator 6, the seals are twice the throw of the crank shaft from the top of the rotor 3.

Each of these sealing rings 15, 16, 17 are formed in the side plate 6 and porting side plate 7, so that the working space between each vane 13 is sealed. The vanes 13 slide with small clearance in the slots 14, and are either biased outwardly by springs not shown, or positively moved outwardly by means not shown. As the rotor moves backwards and forwards during its orbital motion, the vane 13 in the slot 14 will be pressed against the side of the slot opposite the chamber of highest compression, and if there is any tendency of the fluid to move down the slot, this contact will prevent its escape. The rings 17 and 16 thus enclose the blade slot areas and any leakage of fluid from this area is minimised.

Figure 4:
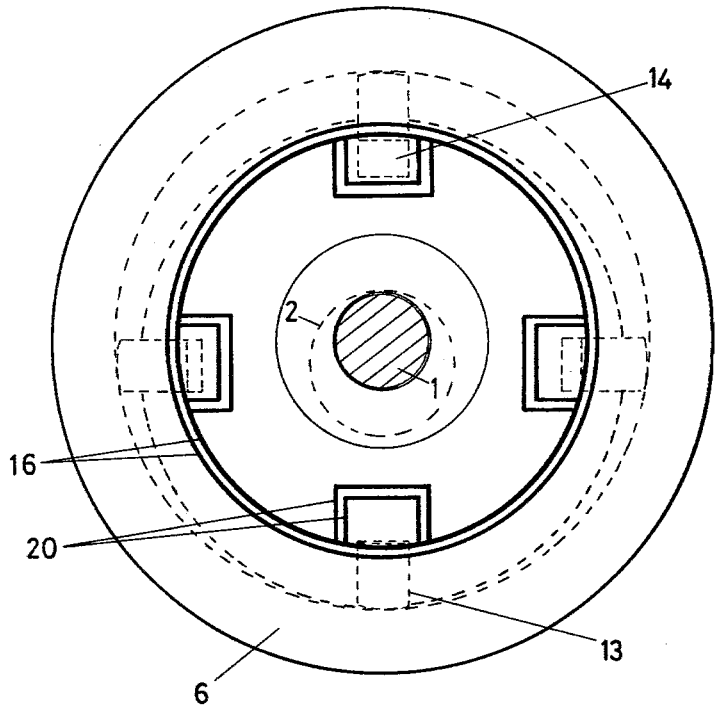
FIG. 4 shows an alternative form of the invention similar to FIG. 2.

A further alternative is shown in FIG. 4 where the blade seals instead of being part circular are formed in straight sections 20 to enclose the blade slot area.

Figure 5:
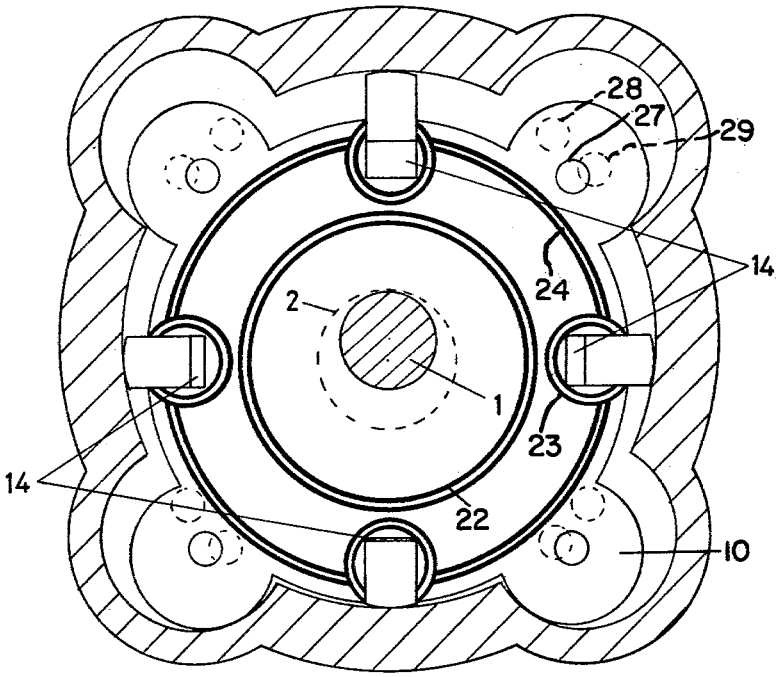
FIG. 5 shows a further embodiment of the invention.

FIG. 5 shows a further embodiment similar to FIG. 2 but with the view taken in the opposite direction, that is looking towards the porting side plate, and also showing diagrammatically the lobe plate and recesses.

In this embodiment the sealing means are provided in the rotor end face, so that the oil control seals 22 are formed in the rotor end face. Also the vane slot seals 23 to encircle the vane slots 14 are similarly formed in the end face of the rotor together with the compression seals 24. The compression seals 24 are each arcs of a circle, and the vane seals 23 are resiliently formed to tend to expand to a greater diameter and hence press outwardly against the ends of the compression seals 24.

The flow of fluid into the working chambers is controlled by the lobe 10 forming a slide valve between resilient valve plates 25 and 26. The lobes 10 each have an aperture 27 therethrough and the valve plates 25 and 26 each have ports 28 and 29 therethrough, these ports continuing through the porting side plates 7 and the enclosing plate 12. The valve plates 25 and 26 are of sufficient size that the lobe port 27 in its path as indicated by the dotted line 30 does not pass off the plate.

Each of the plates 25 and 26 are biased by springs 31, 32 towards the lobe plate 10, so that the plates 25 and 26 and the lobe plate 10 seal therebetween, each spring preferably being a wave spring. Preferably also each port 28 and 29 and the porting side plate 7 and the enclosing plate 12 have sleeves therein to protrude with a sliding fit into the respective ports in the lobe plate 10, so that the plates 25 and 26 can move relative to the sleeves 33 without causing leakage or a path for loss of pressure. Preferably the port for the outlet port could have small holes through the sleeve 33 opening into the space containing the springs 31,32 to thus equalise the pressure during the exhaust on both sides of the valve plates 25 and 26.

By utilising the sealing system of the present invention it is not then necessary to provide seals in the vane slots themselves to prevent loss of pressure there around or therethrough, but by the provision of the vane slot seals to encircle the vane slot area, and to co-operate with the compression seal, that the working chamber is closed and that there is no loss of pressure therefrom.

Although various forms of the invention have been described in some detail it is to be realised that the invention is not to be limited thereto but can include various modifications falling within the spirit and scope of the invention.

I claim:

1. A rotary machine comprising a hollow casing, a rotor freely mounted on an eccentric shaft within the cavity, spaced lobes fixed in relation to the rotor and cooperating in recesses in the casing, with the recesses and lobes constraining the rotor to partake of orbital movement without rotation during rotation of the shaft, a plurality of vanes mounted in slots in the rotor to engage the interior of the casing to form working chambers therebetween, and sealing means between the end faces of the rotor and the respective end walls of the casing to seal therebetween to prevent escape of working fluid therebetween and from around the vane slots, characterized in that the lobes form sliding valves for admitting and exhausting fluid to the working chamber, the lobes having an aperture therethrough to cooperate with spaced apertures forming inlet and outlet ports in an end wall of the casing.

2. A rotary machine as defined in claim 1 wherein the lobe operates between spaced valve plates carrying said inlet and outlet ports which plates are resiliently biased towards said lobe.

* * * * *